US007661526B2

(12) United States Patent
Lin

(10) Patent No.: US 7,661,526 B2
(45) Date of Patent: Feb. 16, 2010

(54) TOOLBOX WITH PIVOTED COVER

(75) Inventor: Jack Lin, Nantou (TW)

(73) Assignee: Yih Cheng Factory Co., Ltd., Taichung (TW)

( * ) Notice: Subject to any disclaimer, the term of this patent is extended or adjusted under 35 U.S.C. 154(b) by 124 days.

(21) Appl. No.: 12/102,037

(22) Filed: Apr. 14, 2008

(65) Prior Publication Data

US 2009/0255840 A1 Oct. 15, 2009

(51) Int. Cl.
*B65D 85/28* (2006.01)

(52) U.S. Cl. ..... 206/379; 206/373; 206/759

(58) Field of Classification Search ..... 206/372–379, 206/759; 211/70.6
See application file for complete search history.

(56) References Cited

U.S. PATENT DOCUMENTS 5,108,287 A * 4/1992 Yee et al. ..... 206/379
5,535,882 A * 7/1996 Liu ..... 206/377
6,050,409 A * 4/2000 Delbeck et al. ..... 206/375
6,988,616 B2 * 1/2006 Chen ..... 206/379
7,168,559 B2 * 1/2007 Chen ..... 206/373
7,428,970 B2 * 9/2008 Chen ..... 206/372
2008/0314795 A1 * 12/2008 Lin ..... 206/759

* cited by examiner

*Primary Examiner*—Byron P Gehman
(74) *Attorney, Agent, or Firm*—Banger Shia

(57) ABSTRACT

A toolbox includes a shell, a holder and a cover. The shell includes two grooves defined therein and two inclined faces formed thereon near the grooves. The holder is disposed in the shell and formed with a plurality of holes for receiving bits. The cover includes two lugs extended from a side thereof and two blocks each formed on a related one of the lugs and formed with an inclined face. The blocks are movably disposed in the grooves so that the cover can be moved relative to the shell. When the cover is moved away from the shell, the cover can be pivoted relative to the shell so that the inclined faces of the blocks are located against the inclined faces of the shell, thus limiting the pivoting of the cover relative to the shell.

7 Claims, 5 Drawing Sheets

TOOLBOX WITH PIVOTED COVER

FIELD OF INVENTION

The present invention relates to a toolbox and, more particularly, to a toolbox for storing and displaying a tool kit.

BACKGROUND OF INVENTION

A screwdriver is a convenient tool operable for driving threaded bolts. A conventional screwdriver includes a handle and a shank secured to the handle. The tip of the shank is made of one type and size. As there are various types and sizes of the heads of the threaded bolts, a user has to acquire screwdrivers with tips of various types and sizes. This is an expensive practice and requires a lot of space for storage.

To overcome the foregoing problem, there has been devised a tool kit including a handle for engagement with bits of various types and sizes. This reduces the cost and the space for storage. The tool kit is often stored in a toolbox.

A conventional toolbox includes a shell and a cover for keeping a tool kit in the shell. When the toolbox is opened, the shell is laid on a horizontal surface such as a table or the ground. If the bits are firmly disposed in the shell, a user will have to hold the shell with one hand and take a tool from the shell with the other hand. If not, the bits might be dropped from the toolbox and lost.

Therefore, the present invention is intended to obviate or at least alleviate the problems encountered in prior art.

SUMMARY OF INVENTION

It is the primary objective of the present invention to provide a toolbox for storing and displaying a tool kit.

To achieve the foregoing objective, the toolbox includes a shell, a holder and a cover. The shell includes two grooves defined therein and two inclined faces formed thereon near the grooves. The holder is disposed in the shell and formed with a plurality of holes for receiving bits. The cover includes two lugs extended from a side thereof and two blocks each formed on a related one of the lugs and formed with an inclined face. The blocks are movably disposed in the grooves so that cover can be moved relative to the shell. When the cover is moved away from the shell, the cover can be pivoted relative to the shell so that the inclined faces of the blocks are located against the inclined faces of the shell, thus limiting the pivoting of the cover relative to the shell.

Other objectives, advantages and features of the present invention will become apparent from the following description referring to the attached drawings.

BRIEF DESCRIPTION OF DRAWINGS

The present invention will be described via the detailed illustration of the preferred embodiment referring to the drawings.

DETAILED DESCRIPTION OF PREFERRED EMBODIMENT

Figure 1:
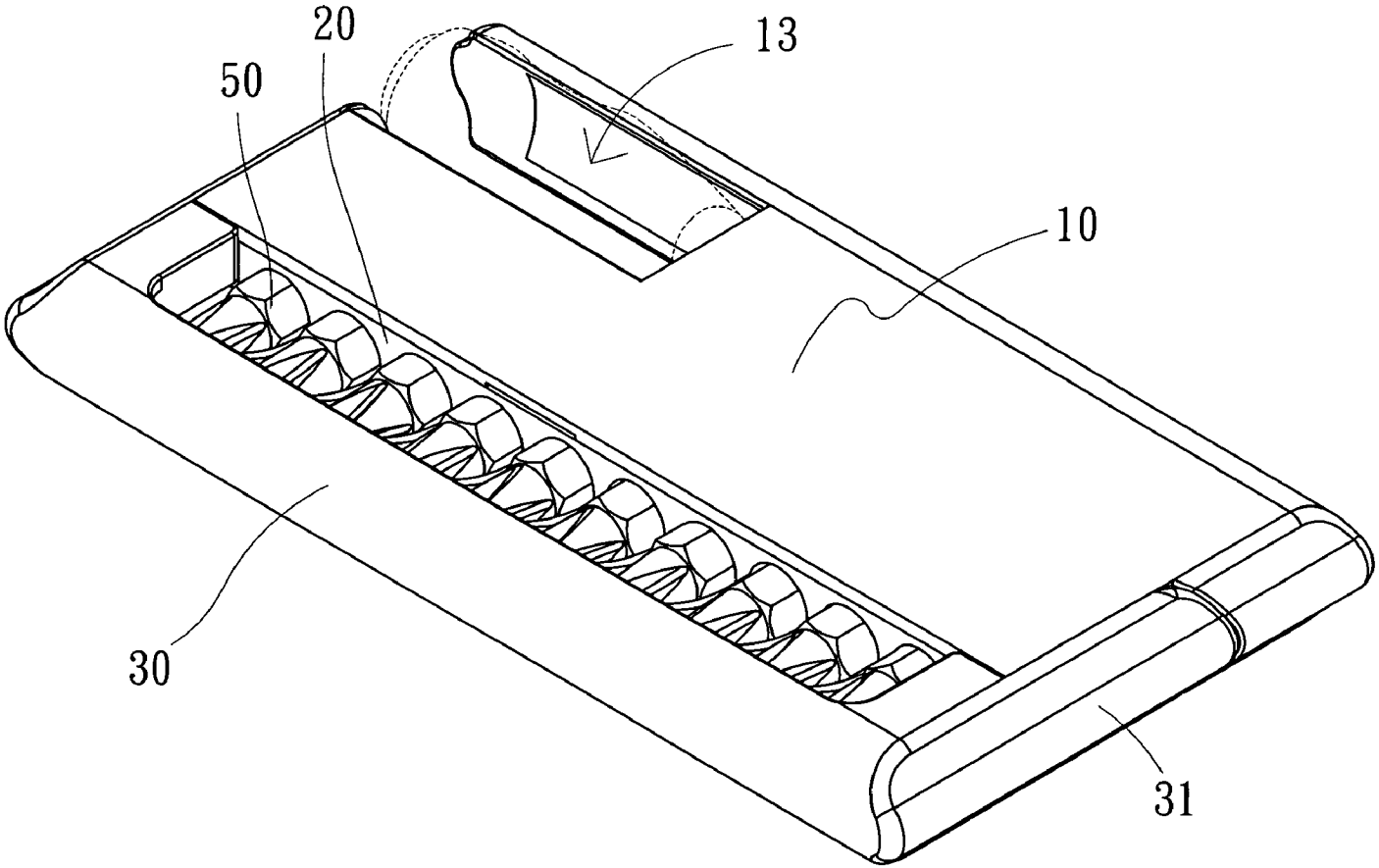
FIG. 1 is a perspective view of a toolbox according to the preferred embodiment of the present invention.
Figure 2:
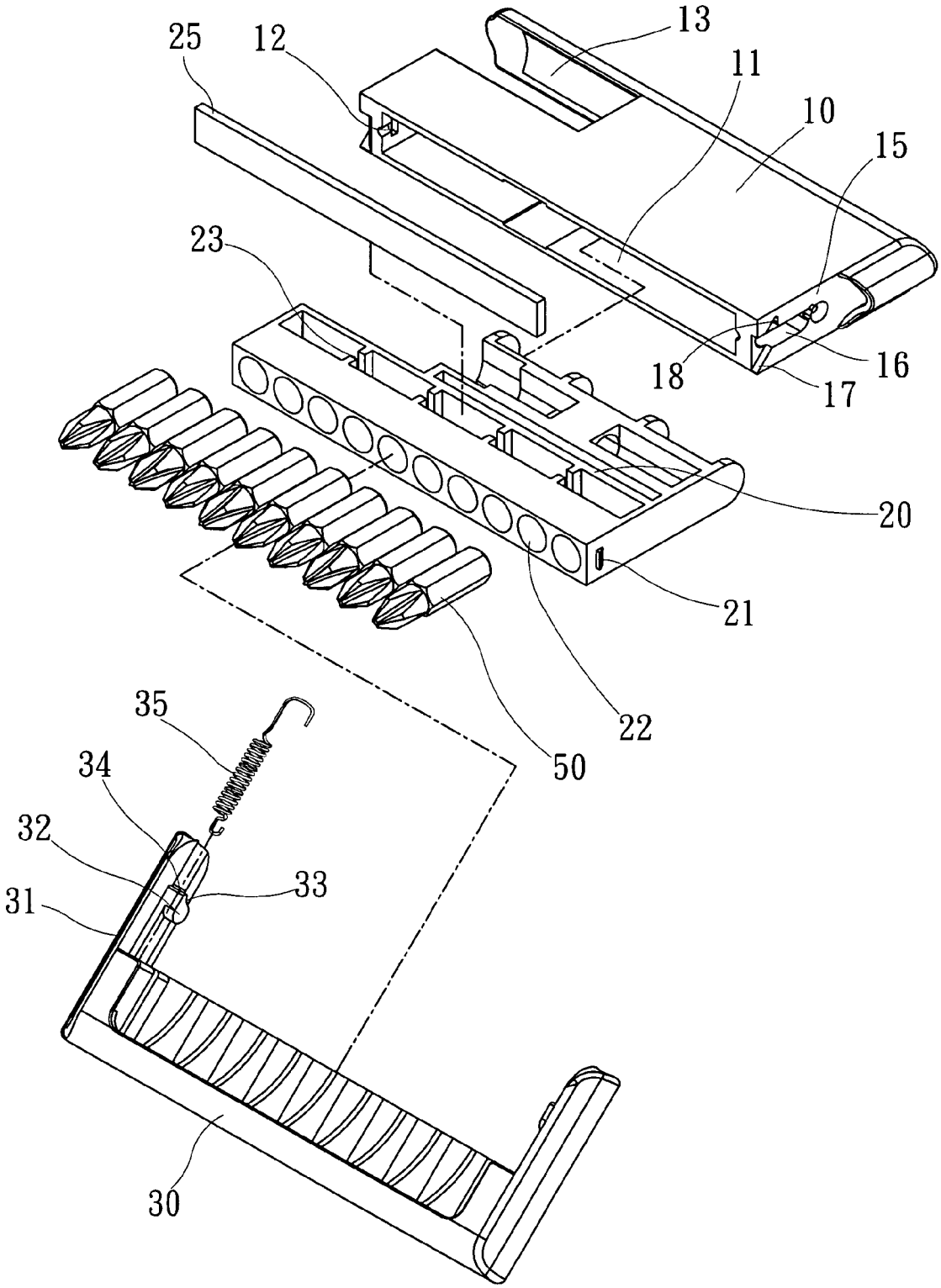
FIG. 2 is an exploded view of the toolbox shown in FIG. 1.
Figure 3:
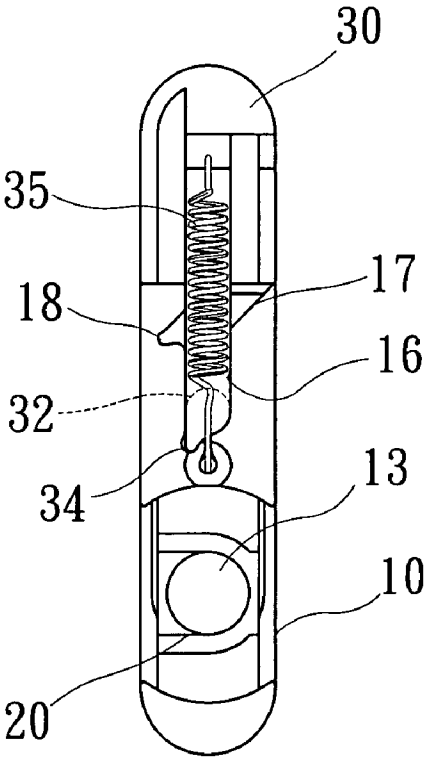
FIG. 3 is a cross-sectional view of the toolbox shown in FIG. 1.

Referring to FIGS. 1 to 3, a toolbox includes a shell 10, a holder 20 disposed in the shell 10 and a cover 30 connected to the shell 10 according to the preferred embodiment of the present invention.

The shell 10 is substantially a parallelepiped with a first side, a second side parallel to the first side, a third side 15 perpendicular to the first side, a fourth side 15 parallel to the third side 15, a fifth side perpendicular to the first side and a sixth side parallel to the fifth side. The shell 10 includes a space 11 defined in the first side, a cavity 13 defined in the third side 15 and a groove 16 defined in each of the third and fourth sides 15. There are two recesses 12 defined in the wall of the space 11. An inclined face 17 is formed on each of the third and fourth sides 15 near the groove 16. A cutout 18 is defined in each of the third and fourth sides 15 so that the cutout 18 is in communication with the groove 16.

The holder 20 includes two ridges 21 formed thereon corresponding to the recesses 12, a plurality of holes 22 defined therein and a slot 23 defined therein. The holes 22 are located between the ridges 21. The slot 23 is in communication with the holes 22.

The cover 30 includes two lugs 31 formed thereon. A block 32 is formed on each of the lugs 31 so that the blocks 32 are directed towards each other. Each of the blocks 32 includes an inclined face 33 formed thereon and a lobe-shaped portion 34 formed next to the inclined face 33.

In assembly, the holder 20 is inserted in the space 11. The ridges 21 are disposed in the recesses 12 so that the holder 20 is retained in the shell 10. The blocks 32 are movably disposed in the grooves 16. A spring 35 is provided between the cover 30 and the shell 10 so that the cover 30 tends to move towards the shell 10.

In use, a handle of a tool such as a screwdriver can be disposed in the space 13. Bits 50 can be disposed in the holes 22. If the length of the bits 50 is shorter than the depth of the holes 22, a slat 25 can be inserted into the holes 22 through the slot 23. Thus, each of the bits 50 includes an end located against the slat 25 and an opposite end located outside a related one of the holes 22 so that it can easily be taken and used.

Figure 4:
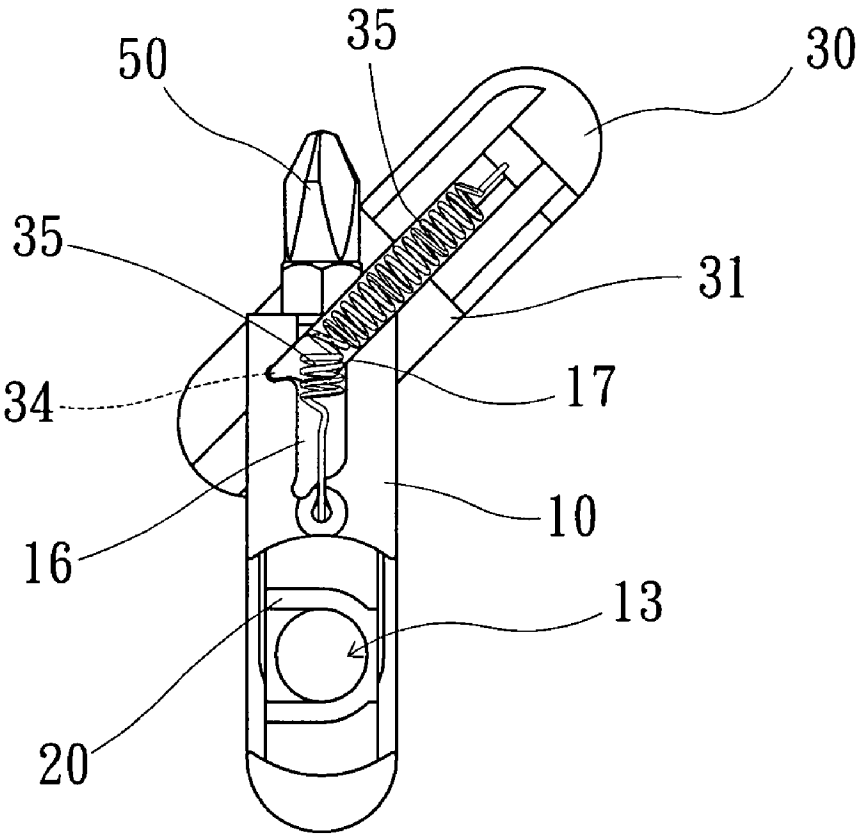
FIG. 4 is a cross-sectional view of the toolbox in another position than shown in FIG. 3.
Figure 5:
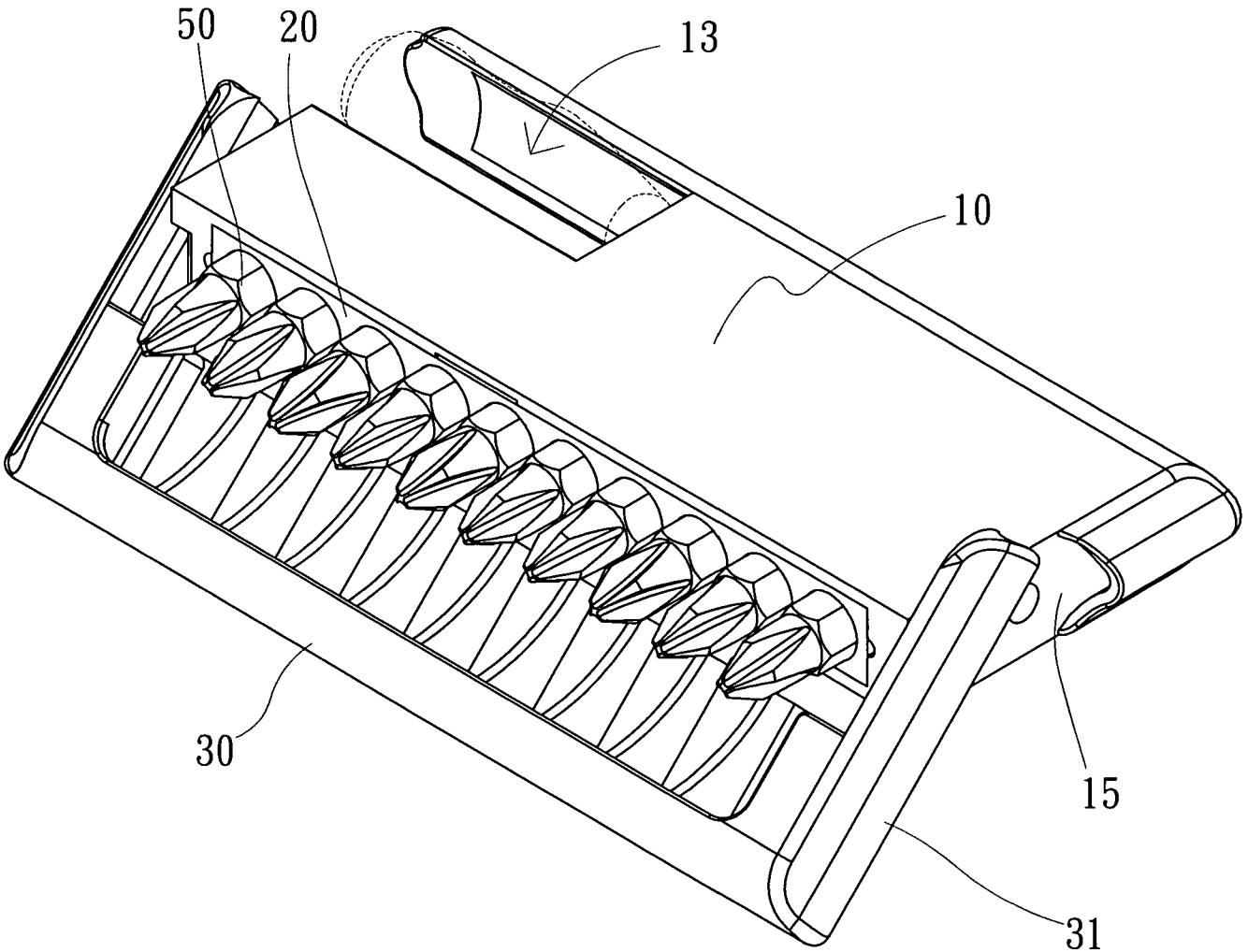
FIG. 5 is a perspective view of the toolbox in another position than shown in FIG. 1.

Referring to FIGS. 4 and 5, to open the toolbox, the cover 30 is pulled away from the shell 10 while the blocks 32 are moved in the grooves 16. Then, the cover 30 is pivoted relative to the shell 10 so that there is an obtuse angle between them. Finally, the lobe-shaped portions 34 of the blocks 32 are inserted in the cutouts 18, and the inclined faces 33 are located against the inclined faces 17. Thus, the toolbox is kept open. There is an acute angle between the holder 20 and a horizontal surface such as a table or the ground. The bits 50 are kept from the horizontal surface and directed upwards obliquely so that they can easily be taken from the holder 20 and used.

To close the toolbox, the lobe-shaped portions 34 of the blocks 32 are removed from the cutouts 18, and the inclined faces 33 are removed from the inclined faces 17. Then, the cover 30 is pivoted relative to the shell 10 so that they are substantially coplanar. Now, the spring 35 causes the cover 30 to move towards the shell 10 while the blocks 32 are moved in the grooves 16. Thus, the toolbox is closed.

As discussed above, the toolbox stores the bits 50. In the open position, the toolbox displays the bits 50. The bits 50 are directed upwards obliquely. A user can easily take any of the bits 50 from the holder 20 with only one hand since the weight of the other bits and the toolbox will keep them still.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A toolbox comprising:

a shell defining an internal space and further comprising two grooves defined therein and two inclined faces formed thereon adjacent the grooves;

a holder disposed in the space of the shell and formed with a plurality of holes for receiving tool bits; and a cover comprising two lugs extended from a side thereof and two blocks each formed on a related one of the lugs and formed with an inclined face, wherein the blocks are movably disposed in the grooves so that the cover can be moved relative to the shell, wherein when the cover is moved away from the shell, the cover can be pivoted relative to the shell so that the inclined faces of the blocks are located against the inclined faces of the shell, thus limiting the pivoting of the cover relative to the shell.

2. The toolbox according to claim 1, wherein the shell comprises one recess defined in each of two opposing internal sides of said space, and each of the lugs is formed with a ridge for insertion in a respective said recess, thus retaining the toolbox closed.

3. The toolbox according to claim 1, wherein the shell comprises a cavity defined in a side thereof for receiving a handle.

4. The toolbox according to claim 1, wherein the shell comprises two parallel sides in each of which a related one of the grooves is defined.

5. The toolbox according to claim 1, wherein the shell comprises two cutouts each in communication with a related one of the grooves, and each of the blocks comprises a lobe-shaped portion for insertion in a related one of the cutouts, thus retaining the cover at a predetermined angle relative to the shell.

6. The toolbox according to claim 1, wherein the holder comprises a slot in communication with the holes for receiving a slat for supporting an end of each of the bits so that the length of the bits will be shorter than the depth of the holes so that an opposite end of each of the bits will be located outside the holder.

7. The toolbox according to claim 1 comprising a spring between the shell and the cover for causing the cover to move towards the shell.

* * * * *